US011149507B2

(12) United States Patent
Tran

(10) Patent No.: US 11,149,507 B2
(45) Date of Patent: Oct. 19, 2021

(54) ROTATING CONTROL DEVICE

(71) Applicant: Schlumberger Technology Corporation, Sugar Land, TX (US)

(72) Inventor: Lap Tran, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/640,049

(22) PCT Filed: Sep. 17, 2018

(86) PCT No.: PCT/US2018/051270
§ 371 (c)(1),
(2) Date: Feb. 18, 2020

(87) PCT Pub. No.: WO2019/060233
PCT Pub. Date: Mar. 28, 2019

(65) Prior Publication Data

US 2021/0131205 A1 May 6, 2021

Related U.S. Application Data

(60) Provisional application No. 62/560,651, filed on Sep. 19, 2017.

(51) Int. Cl.
*E21B 17/01* (2006.01)
*E21B 33/06* (2006.01)
(Continued)

(52) U.S. Cl.
CPC ..... *E21B 21/08* (2013.01); *E21B 33/085* (2013.01); *E21B 4/003* (2013.01); *E21B 17/01* (2013.01); *E21B 33/06* (2013.01)

(58) Field of Classification Search
CPC ..... E21B 4/003; E21B 17/01; E21B 21/08; E21B 33/06; E21B 33/085
See application file for complete search history.

(56) References Cited

U.S. PATENT DOCUMENTS 3,297,091 A * 1/1967 Dale ..... E21B 33/085 166/84.3
3,934,887 A * 1/1976 Biffle ..... E21B 33/085 166/84.3

(Continued)

FOREIGN PATENT DOCUMENTS

WO 9918323 A1 4/1999
WO 2016028340 A1 2/2016
WO 2017052190 A1 3/2017

OTHER PUBLICATIONS

International Preliminary Report on Patentability for the International patent application PCT/US2018/051270 dated Apr. 2, 2020.

(Continued)

*Primary Examiner* — Matthew R Buck

(57) ABSTRACT

An apparatus includes a non-rotating housing, a rotatable member rotatably supported in the non-rotating housing and a bearing adapter sleeve disposed externally to the non-rotating housing. The bearing adapter sleeve has an internal upset for limiting longitudinal movement of the non-rotating housing. The bearing adapter sleeve has a retaining ring affixed to a longitudinal end of the bearing adapter sleeve to limit longitudinal movement of the non-rotating housing.

13 Claims, 3 Drawing Sheets

(51) Int. Cl.

| | |
|---|---|
| ***E21B 21/08*** | (2006.01) |
| ***E21B 33/08*** | (2006.01) |
| *E21B 4/00* | (2006.01) |

(56) References Cited

U.S. PATENT DOCUMENTS

| | | | | |
|---|---|---|---|---|
| 4,480,703 | A | 11/1984 | Garrett | |
| 5,848,643 | A * | 12/1998 | Carbaugh | E21B 33/085 166/85.4 |
| 6,904,981 | B2 | 6/2005 | van Riet | |
| 7,185,719 | B2 | 3/2007 | van Riet | |
| 7,350,597 | B2 | 4/2008 | Reitsma et al. | |
| 7,699,109 | B2 * | 4/2010 | May | E21B 17/01 166/367 |
| 9,856,713 | B2 * | 1/2018 | Tarique | E21B 33/085 |
| 2002/0070014 | A1 | 6/2002 | Kinder | |
| 2012/0318496 | A1 * | 12/2012 | Bailey | E21B 33/085 166/84.3 |
| 2016/0290088 | A1 * | 10/2016 | DeWesee, Jr. | E21B 4/003 |

OTHER PUBLICATIONS

International Search Report and Written Opinion for the International patent application PCT/US2018/051270 dated Jan. 28, 2019.
Search and Examination Report R. 62 issued in European Patent Application 18859476, dated May 3, 2021, 7 pages.

* cited by examiner

ROTATING CONTROL DEVICE

This application claims priority to, and the benefit of, U.S. Provisional Patent Application No. 62/560,651, filed Sep. 19, 2017, which is expressly incorporated herein by this reference in its entirety.

BACKGROUND

This disclosure relates to the field of rotating control devices used in wellbore drilling and intervention. More specifically, the disclosure relates to bearing and seal assemblies for rotating control devices.

Some drilling procedures include changing the fluid pressure exerted by the column of mud in the annulus. Such drilling procedures include "managed pressure drilling" (MPD) wherein a sealing element, called a rotating control device ("RCD") is disposed at a selected longitudinal position in the annulus and a fluid outlet is provided below the RCD such that returning mud from the annulus may have its flow rate and/or pressure controlled, for example, using an adjustable orifice choke or other flow control device. MPD may enable using different density ("weight") mud than would otherwise be required in order to provide sufficient hydrostatic pressure to keep fluid in exposed formations in the wellbore from entering the wellbore. An example method for MPD is described in U.S. Pat. No. 6,904,981 issued to van Riet, U.S. Pat. No. 7,185,719 issued to van Riet, and U.S. Pat. No. 7,350,597 issued to Reitsma.

Various designs exist to enable changing bearings and seals in a rotating control device while leaving a housing connected to a conduit such as a drilling riser.

DETAILED DESCRIPTION

Figure 1:
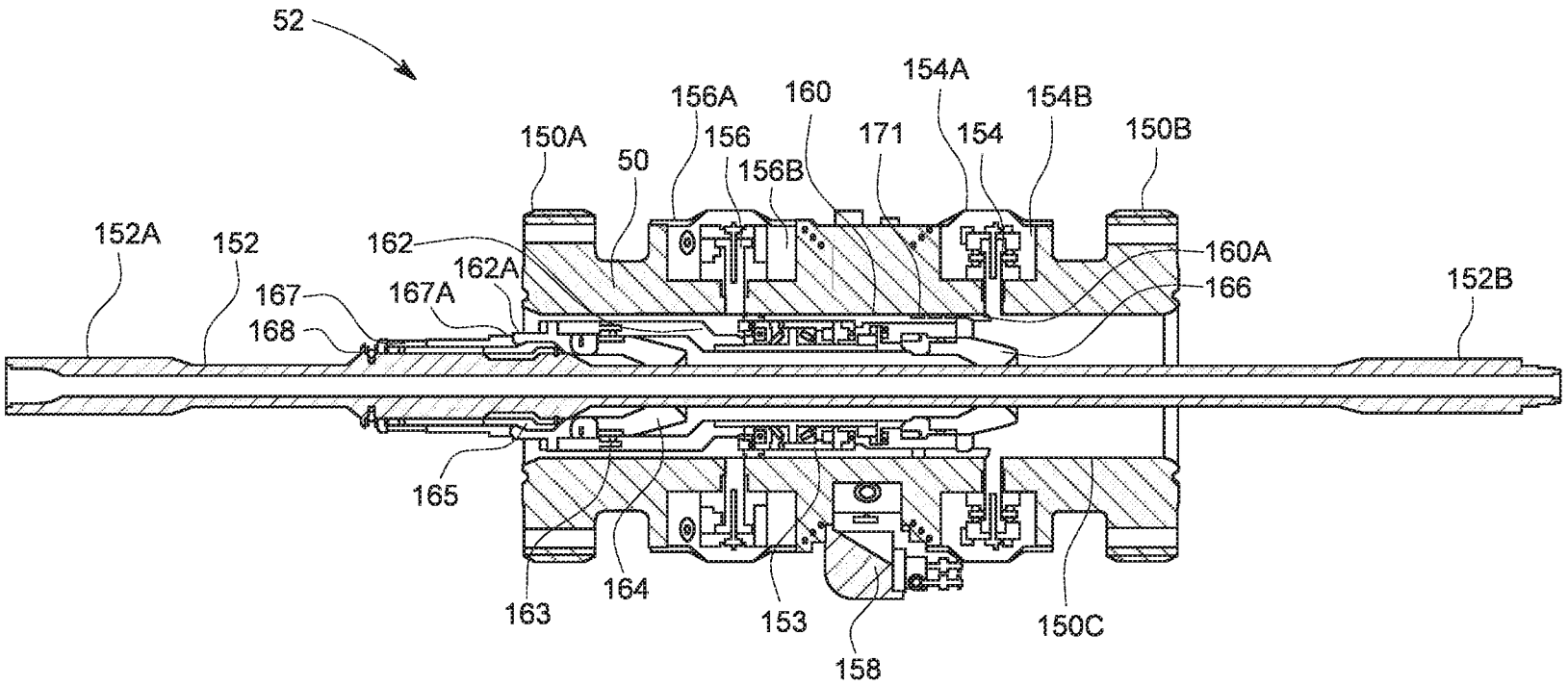
FIG. 1 shows an example embodiment of a rotating control device (RCD).

An example embodiment of a rotating control device ("RCD") is shown in FIG. 1. The RCD 52 may be disposed within a RCD housing 50. The RCD housing 50 may be coupled within a riser (not shown) as explained with reference to FIG. 1. In some embodiments, the RCD housing 50 may comprise a coupling 150A, 150B, respectively, at each longitudinal end for coupling the RCD housing 50 into a riser (not shown). In the present example embodiment, the couplings 150A, 150B may be bolted flanges. The RCD housing 50 may comprise a through bore 150C along the longitudinal dimension of the RCD housing 50.

The RCD housing 50 may comprise one or more first locking elements 154 disposed at a selected longitudinal position along the RCD housing 50. In the present example embodiment, the one or more first locking elements 154 may comprise pistons. Pistons may be disposed in respective pockets 154B formed in or affixed to a side wall of the RCD housing 50. In some embodiments, each pocket 154B may be sealed on an outer end by a respective cover 154A. Fluid pressure, for example hydraulic fluid under pressure, may be selectively applied to one side of the one or more first locking elements 154 (e.g., pistons) to extend them radially inwardly into the through bore 150C. When the one or more first locking elements 154 (e.g., pistons) are extended inwardly, a landing surface 160A may be formed for a bearing adapter sleeve 160. Fluid pressure may be used to retract the one or more first locking elements 154 (e.g., pistons) when disassembly of the RCD 52 is desired. The bearing adapter sleeve 160 will be explained in more detail with reference to FIGS. 2 and 3. The through bore 150C may comprise an enlarged internal diameter ring or groove 171 for receiving a seal (see FIG. 3) disposed on an outer surface of the bearing adapter sleeve 160.

It will be appreciated that using pistons for the one or more first locking elements 154 is only one example embodiment of the first locking elements 154. Other embodiments may comprise, for example and without limitation, motor rotated jack screws, electric solenoid operated plungers or any similar device which may be extended radially into the through bore 150C to form the landing surface 160A.

A bearing and seal assembly, to be explained in more detail with reference to FIG. 2, may comprise a lower rotating seal 166, for example made from resilient material such as elastomer, to sealingly engage an outer surface of any part of a drill string (not shown) passing through the lower rotating seal 166. The bearing and seal assembly may comprise an upper rotating seal 164 similar in material and configuration to the lower rotating seal 166. The lower rotating seal 166 and the upper rotating seal 164 may be coupled to a rotatable member 162. The rotatable member 162 may be supported by bearings (see FIG. 2) within a non-rotating housing 153. The non-rotating housing 153 may be disposed within the bearing adapter sleeve 160 as will be explained in more detail with reference to FIG. 2.

The bearing and seal assembly may be inserted into the RCD housing 50 and retrieved therefrom using a running tool assembly. An example embodiment of a running tool assembly may comprise a running tool mandrel 152 having couplings 152A, 152B at each longitudinal end, for example, threaded connections, for coupling the running tool mandrel 152 to part of a drill string (not shown) to insert the bearing and seal assembly into the RCD housing 50 or to retrieve the bearing and seal assembly therefrom. The running tool assembly may also comprise a landing sleeve 167 coupled to an exterior of the running tool mandrel 152, for example, by capscrews 168. The landing sleeve 167 may comprise a shoulder 167A that engages an upper surface of the rotatable member 162 when the running tool mandrel 152 is inserted into the bearing and seal assembly. A collet assembly 161 may be disposed in a corresponding feature in an exterior surface of the running tool mandrel 152. The collet assembly 161 may engage a mating feature 162A disposed on the interior surface of the rotatable member 162 so as to lock the running tool mandrel 152 to the rotatable member 162.

When the bearing and seal assembly are disposed in the RCD housing 50 so that the bearing adapter sleeve 160 is in contact with the landing surface formed 160A by the extended one or more first locking elements 154 (e.g., pistons), the bearing and seal assembly may be locked in place longitudinally within the RCD housing 50 by operating one or more second locking elements 156. The one or more second locking elements 156 in some embodiments may be pistons, for example, fluid pressure operated pistons each disposed in a respective cylinder 156B sealed on an exterior by a respective cover 156A. Fluid pressure, for example, hydraulic fluid under pressure may be used to extend the one or more second locking elements 156 (e.g., pistons) radially inwardly to retain the bearing adapter sleeve 160 longitudinally within the RCD housing 150 through bore 150C. The second locking elements 156 may be retracted when disassembly of the RCD 52 is desired. Pistons being used for the second locking elements 156 is only one example embodiment of the second locking elements 156. Other embodiments may use different structures for the second locking elements 156, for example and without limitation the structures described above with reference to the first locking elements 154 With the bearing and seal assembly thus retained in the RCD housing 150, the running tool assembly may be removed from the bearing and seal assembly by exerting upward (longitudinal) force on the running tool mandrel 152. Such upward force may cause shear screws 163 to break, thus enabling the running tool mandrel 152 to disengage from the rotatable member 162. The RCD 50 is then ready for use during, for example, drilling operations.

Figure 2:
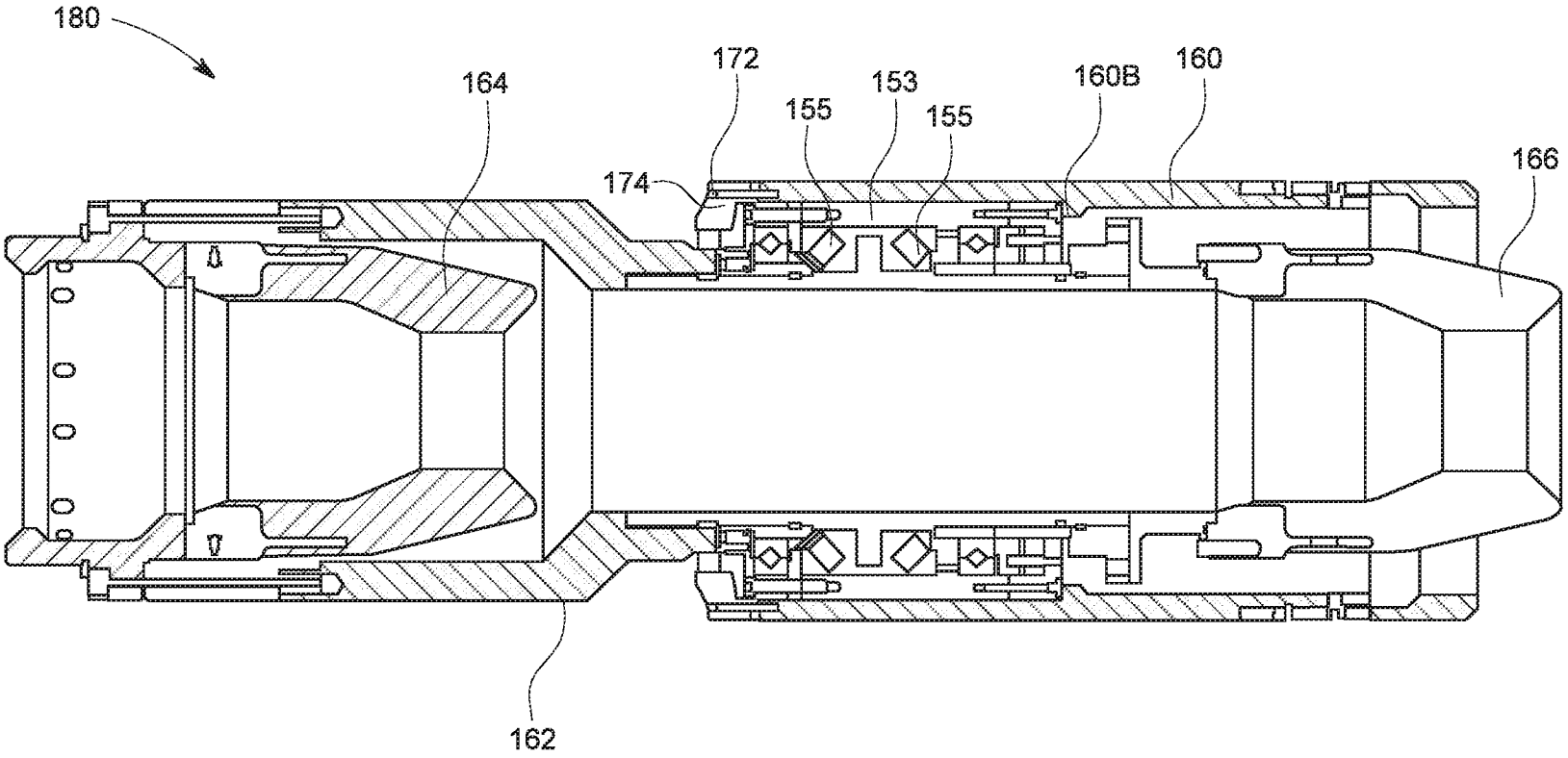
FIG. 2 shows an example embodiment of a bearing and seal assembly disposed in an adapter sleeve.

An example embodiment of the bearing and seal assembly is shown in more detail in FIG. 2. The bearing and seal assembly 180 may comprise a non-rotating housing 153 that may be configured similarly to non-rotating housings of RCDs known in the art. The rotatable member 162, as explained above, may be rotatably supported in the non-rotating housing 153 by bearings 155, for example, tapered roller bearings that may carry both axial and radial load. In the present example embodiment, there may be two sets of oppositely oriented tapered roller bearings. The rotatable member 162 may also be configured as are such rotatable members in RCDs known in the art. The upper rotating seal 164 and the lower rotating seal 166 shown in FIG. 2 may be configured as explained with reference to FIG. 1.

In the present example embodiment of the bearing and seal assembly 180, the non-rotating housing 153 may be disposed in the bearing adapter sleeve 160. The bearing adapter sleeve 160 may comprise an internal upset 160B which forms a landing surface for one longitudinal end of the non-rotating housing 153. In some embodiments, the internal upset 160B may be formed into the interior surface of the adapter sleeve 160 such as by machining. In some embodiments the internal upset 160B may be a ring affixed to the inner surface of the adapter sleeve 160.

A retainer such as a split retaining ring 174 may be coupled to one longitudinal end of the bearing adapter sleeve 160 using selected tensile and/or shear strength fasteners 172 such as capscrews. Other embodiments may use bolts, pins or other types of screws. The present embodiment of the selected tensile and/or shear strength fasteners 172 is not intended to limit the scope of the present disclosure. The selected tensile and/or shear strength fasteners 172 have a tensile and/or shear strength selected to enable removing the bearing and seal assembly 180 from the RCD housing (50 in FIG. 1) by reengaging the running tool assembly as explained with reference to FIG. 1 to the rotatable member 162. Then the one or more second locking elements (156 in FIG. 1) may be retracted and upward pull may be applied to the running tool mandrel (152 in FIG. 1). In the event the bearing adapter sleeve 160 becomes stuck in the through bore (150C in FIG. 1) such as may occur by accumulation of drill cuttings, drilling fluid solids or other debris, continued upward pull on the running tool mandrel (152 in FIG. 1), which force is ultimately transferred to the non-rotating housing 153, may cause the selected tensile and/or shear strength fasteners 172 to break, in the present embodiment in tension. Breaking the selected tensile and/or shear strength fasteners 172 will release the split retaining ring 174. When the split retaining ring 174 is released, the non-rotating housing 153 can be lifted out of the bearing adapter sleeve 160. The rotatable member 162, the upper rotating seal 164 and the lower rotating seal 166 are all coupled to the non-rotating housing 153 and will be withdrawn from the RCD housing (50 in FIG. 1) with the non-rotating housing 153. Thus, in the event the bearing adapter sleeve 160 is unable to be removed from the RCD housing (50 in FIG. 1), by enabling removal of the non-rotating housing 153, all of the bearing and seal assembly 180 except for the adapter sleeve 160 may be removed from the RCD housing (150 in FIG. 1). Removing the foregoing from the RCD housing (50 in FIG. 1) may provide a substantially clear through bore in the RCD housing (50 in FIG. 1) to enable further intervention through the riser (not shown) notwithstanding the stuck bearing adapter sleeve 160. In such circumstances, various operations on a wellbore (not shown 1) may continue without the need to disassemble the riser (not shown).

The tensile and/or shear strength of the selected tensile and/or shear strength fasteners 172 may be chosen so that they will break at a lower upward pulling force on the bearing and seal assembly 180 than that required to break the shear screws (163 in FIG. 1) on the running tool mandrel (152 in FIG. 1). Selecting such tensile strength for the selected tensile and/or shear strength fasteners 172 is possible because the bearing adapter sleeve 160 may be longitudinally locked in place by the second locking elements (156 in FIG. 1) engaging an upper surface of the split retaining ring 174. Thus, the running tool assembly may be disengaged from the bearing and seal assembly 180 by pulling upward with sufficient force to break the shear screws (163 in FIG. 1). When the second locking elements (156 in FIG. 1) are extended, the upward force will be transferred from the split locking ring 174 to the second locking elements (156 in FIG. 1), and thus not transferred to the selected tensile and/or shear strength fasteners 172.

Figure 3:
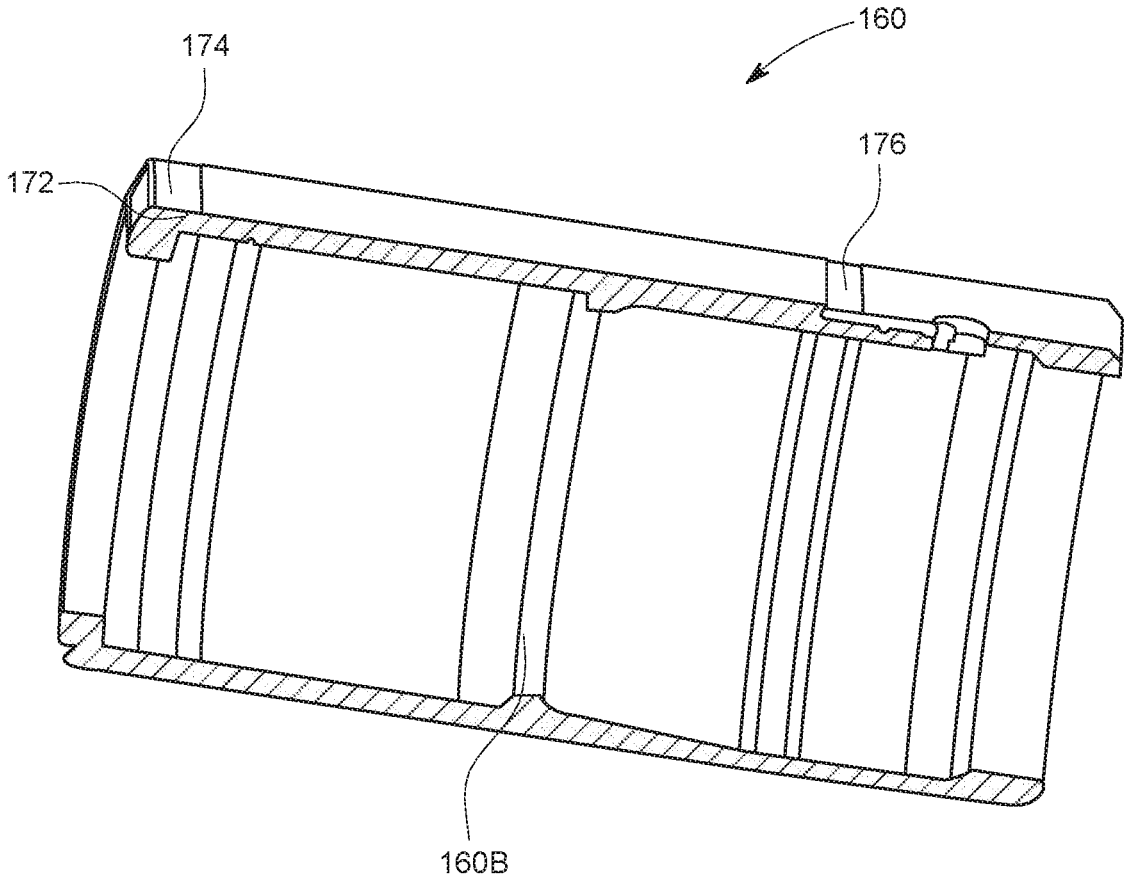
FIG. 3 shows an enlarged view of the example embodiment of the adapter sleeve shown in FIG. 2.

FIG. 3 shows the bearing adapter sleeve 160 in more detail. The internal upset 160B may be observed, as well as the selected tensile and/or shear strength fasteners 172 and split retaining ring 174. The outer surface of the bearing adapter sleeve 160 may have one or more features to retain a seal 176. The longitudinal position of the seal 176 may be selected such that the seal 176 engages the enlarged internal diameter ring or groove (171 in FIG. 1) when the bearing and seal assembly (180 in FIG. 2) is inserted into the RCD housing (50 in FIG. 1). The seal 176 and groove (171 in FIG. 1) cooperatively engage so as to enable inserting the bearing and seal assembly (180 in FIG. 2) into the RCD housing (50 in FIG. 1) without the need to use a protective sleeve on the through bore (150C in FIG. 1). Assembly and disassembly of the RCD (52 in FIG. 2) may be facilitated by removing the need to use a protective sleeve. Another possible benefit of using the bearing adapter sleeve 160 on the non-rotating housing (153 in FIG. 2) is that the bearing and seal assembly 180 may be disposed in a RCD housing having a larger diameter than would otherwise be required to be used in connection with the non-rotating housing (153 in FIG. 2). Thus, one size of non-rotating housing may be used with RCD housings having differing internal diameter.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. An apparatus, comprising:

a non-rotating housing;

a rotatable member rotatably supported in the non-rotating housing; and a bearing adapter sleeve disposed externally to the non-rotating housing, the bearing adapter sleeve having an internal upset for limiting longitudinal movement of the non-rotating housing, the bearing adapter sleeve having a retaining ring affixed to a longitudinal end of the bearing adapter sleeve to limit longitudinal movement of the non-rotating housing, wherein the retaining ring is affixed to the longitudinal end of the bearing adapter sleeve using fasteners having a tensile and/or shear strength selected to break the fasteners at an axial force on the rotatable member lower than an axial force required to disconnect a running tool assembly from the rotatable member.

2. The apparatus of claim 1 further comprising at least one rotating seal coupled to the rotatable member, the at least one seal configured to engage a part of a drill string inserted through the at least one seal.

3. The apparatus of claim 1 wherein the bearing adapter sleeve comprises a seal disposed on an exterior surface of the bearing adapter sleeve.

4. The apparatus of claim 3 wherein the seal disposed on the exterior surface of the bearing adapter sleeve is positioned to engage a groove formed in an internal surface of a rotating control device housing when the bearing adapter sleeve is moved into the rotating control device housing.

5. The apparatus of claim 4 wherein the rotating control device housing comprises at least one first locking element and at least one second locking element each arranged to be extendable radially inwardly to a through bore in the rotating control device housing, a longitudinal position of the at least one first locking element and the at least one second locking element along the through bore selected to retain the bearing adapter sleeve longitudinally within the through bore.

6. The apparatus of claim 5 wherein the at least one first locking element and the at least one second locking element each comprises a piston disposed in a cylinder.

7. The apparatus of claim 4 wherein the rotating control device housing comprises a coupling at each longitudinal end for coupling the rotating control device housing within a conduit.

8. The apparatus of claim 7 wherein the conduit comprises a riser.

9. The apparatus of claim 7 wherein the couplings each comprises a bolt flange.

10. A method, comprising:

inserting a non-rotating housing of a rotating control device bearing and seal assembly into a bearing adapter sleeve until the non-rotating housing contacts a landing surface in the bearing adapter sleeve;

affixing a retaining ring to one longitudinal end of the bearing adapter sleeve whereby the non-rotating housing is longitudinally fixed within the bearing adapter sleeve;

coupling a running tool assembly to a rotatable member rotatably supported in the non-rotating housing;

radially inwardly extending at least one first locking element in a rotating control device housing into a through bore in the rotating control device housing;

extending the running tool assembly into a riser until the bearing adapter sleeve contacts the at least one first locking element;

radially inwardly extending at least one second locking element in the rotating control device housing whereby the bearing adapter sleeve is longitudinally fixed within the rotating control device housing;

disengaging the running tool assembly from the rotatable member;

retracting the at least one second locking element;

reconnecting the running tool assembly to the rotatable member;

applying axial force to the running tool assembly so as to break selected tensile and/or shear strength fasteners coupling the retaining ring to the bearing adapter sleeve; and lifting the rotatable member and the non-rotating housing from the rotating control device housing by applying axial force on the running tool assembly.

11. The method of claim 10 wherein the disengaging the running tool assembly comprises applying axial force to the running tool assembly so as to break shear screws effecting coupling the running tool assembly to the rotatable member.

12. The method of claim 10 wherein the retracting the at least one second locking element comprises applying fluid pressure to a piston.

13. The method of claim 10 wherein the radially extending the at least one first locking element comprises applying fluid pressure to a piston.

* * * * *